United States Patent [19]

Anderson et al.

[11] 4,401,303

[45] Aug. 30, 1983

[54] ATHLETIC REFLEX MACHINE

[76] Inventors: Tyrone D. Anderson, 903 N. Kenwood Ave., Baltimore, Md. 21205; Teng-Fang Lin, 3750 Old York Rd., Baltimore, Md. 21218

[21] Appl. No.: 357,305

[22] Filed: Mar. 11, 1982

[51] Int. Cl.[3] ..... A63B 69/34

[52] U.S. Cl. ..... 272/76; 273/1 GE

[58] Field of Search ..... 273/1 GE, 26 R, 26 D; 272/76, 77, 98, 50; 434/247, 258

[56] References Cited

U.S. PATENT DOCUMENTS 1,985,563 12/1934 Fitzgerald ..... 273/50 UX
3,804,406 4/1974 Viscione ..... 272/76
4,052,058 10/1977 Hintz ..... 273/1 GE
4,353,545 10/1982 Anderson ..... 273/1 GE X

*Primary Examiner*—Harland S. Skogquist
*Attorney, Agent, or Firm*—John F. McClellan, Sr.

[57] ABSTRACT

An athletic reflex machine has a human simulative body pivotally mounted on a pedestal, human-opponent sensing means peering out of a window at the eye position and a respective gimbal-mounted pneumatically powered striker simulating each of the arms and legs; when a user (human target) is sensed within range one or more of the strikers may lash out in the direction in which the target is sensed, regardless of whether the body exactly faces the target; a random interruption is provided to make the response less predictable.

7 Claims, 8 Drawing Figures

AMPLIF.
AIR COMPR.

ATHLETIC REFLEX MACHINE

FIELD OF THE INVENTION

This invention relates generally to athletic training apparatus and specifically to apparatus for locating and striking at a human opponent in Kung Fu practice and the like.

BACKGROUND OF THE INVENTION

At present there is no known sensing apparatus on the market for providing realistic reflexive training in the material arts such as Kung-Fu.

OBJECTS OF THE INVENTION

A principal object of the present invention is to provide a training system for Kung-Fu and the like which is simulative of a live component in that it will pick up and range on the user and strike out reflexibly at the user, but only if the user is within range of the blows that the system can deliver. Further objects are to provide a system as described which is self-contained, sturdy, which can simultaneously turn toward the user and strike out at the user, which is reflexive in operation in simulation of human response, and which is tough and can shift in scanning so that the direction of the blows struck by it is not fixed but is dynamically aimed, and may be in an oblique direction relative to the human-simulation body. Yet another object is to interrupt blow-striking randomly, to make the response less predictable.

BRIEF SUMMARY OF THE INVENTION

In brief summary, the invention includes a scanning sensing system on a gimbal mechanism directing a set of strikers also on gimbals and actuation circuitry so that where a target is sensed in range, one or more strikers may lash out at the target and, if necessary, the body may pivot to help this action.

This invention includes a body which is pivotal on a vertical axis supported by a base. The ranging system is well known in principle and scans in horizontal and in vertical arcs and in depth relative to the body.

The sensor is a photoelectric cell which has a conventional collimated path so that it can view only along a restricted line of sight.

A light source is pivotally mounted on a vertical axis off-set from the photocell in a manner to be carried by ranging system movement in said vertical and horizontal arcs, and is oscillated by a motor so that it scans along the photocell line of sight to locate any reflective object in the photocell line of sight by triangulation, out to a distance predetermined to be sufficient as being the limit of striking-out of the strikers, or the extreme range of the strikers, of the system. Preferably, both photocell and light source scan about a line of sight symmetrically located between the scans of the two, or the scan may be by either along the path of the other. Either method can be used; both are known.

The strikers are gas-extensible bellows, respectively located to serve as "arms" and "legs" of the system. When the photocell receives a reflection it sends out a signal which may cause strikers to orient and to lash out at the user, or the signal may not be sent, depending on whether an interruption prevents this.

Said another way, the ranging system scans in depth and scans horizontally and vertically at all times, relative to the body, until it detects a target. When it detects a target it sends a signal telling the strikers the horizontal position of the target and the elevational position of the target, relative to the body. On receipt of the signal the striker or strikers located closest in line to the direction of the target may simultaneously orient itself or themselves toward the target and lash out in that direction, or they may remain motionless if means supplied to provide delayed action or erratic action interrupts the signal to them. For example, a reflection may remain in the photocell line of sight until an interruption of the signal ends, and there will then be a lashing-out.

The body is normally still but if the target is indicated as being in a sector to the side of the centermost field of scan, the body may be turned by the system to the left or to the right by one increment of 45° either way, to accommodate.

The scanning actuation is through electric motor drive cams. The striker orientation is through an electric servo-system following the scan. The striker actuation is through photocell-responsive solenoid-operated pneumatic valves which admit compressed air to inflate the strikers and cause them thereby to lash-out. When the solenoid-operated valves have no signal they assume a position under spring bias that vents the strikers to the atmosphere through the solenoid valves so that a spring return on each striker can retract it. Conventional solenoid valves are used.

Selection of which striker is actuated in correspondence to position of photocell scan is through a contact array and optionally through an extra switch to impart some randomness to the action. For this, a pointer fixed to the scanner head elevational platform scans the array of contacts, which is fixed to the body of the unit, both in elevation and horizontally (in azimuth) to complete the circuit through a selected contact indicating orientation of the scanner at the time of target-sighting.

BRIEF DESCRIPTION OF THE DRAWINGS

The above and other objects and advantages of the invention will become more readily apparent on examination of the following description including the drawings in which the characters refer to like parts.

DETAILED DESCRIPTION

Figure 1:
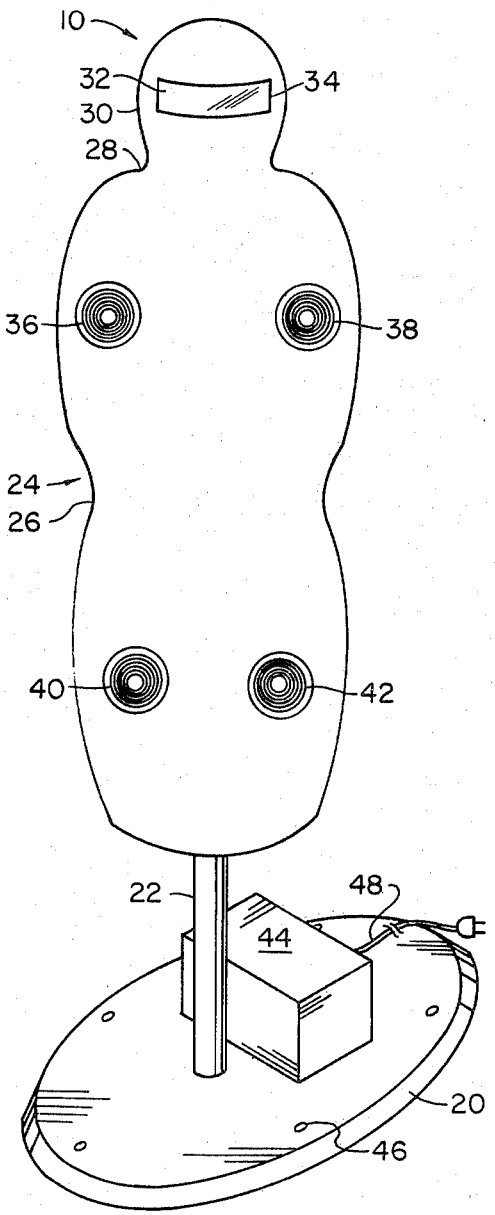
FIG. 1 is a perspective view of the invention in a preferred embodiment.

FIG. 1 shows the invention in embodiment 10 as comprising a base 20 mounting in upright position on a pedestal 22, a hollow body 24 of tough plastic in the general shape of a human torso 26, neck 28 and head 30. A transparent plastic window 32 preferably extends across an opening 34, at the eye location to protect the part of the scanning mechanism to be described, which "looks" out at this location. If desired, the eye locations may be elsewhere on the body.

At each arm location an extensible pneumatic striker 36, 38 is mounted and also at each knee location 40, 42 to the hollow body. All strikers may be the same size or some may be larger.

The base 20 may mount an air compressor 44 and may have holes 46 for securing to the floor. A power cord 48 may extend to any convenient outlet, or alternatively a battery may power the units, if desired, known and conventional principles being followed in any case in the circuitry.

The overall housing is smoothly rounded in contour to offer a human like, injury preventing, durable target.

SENSOR-SCAN DETAILS AND SYSTEM RELATIONS

Figures 2, 3:
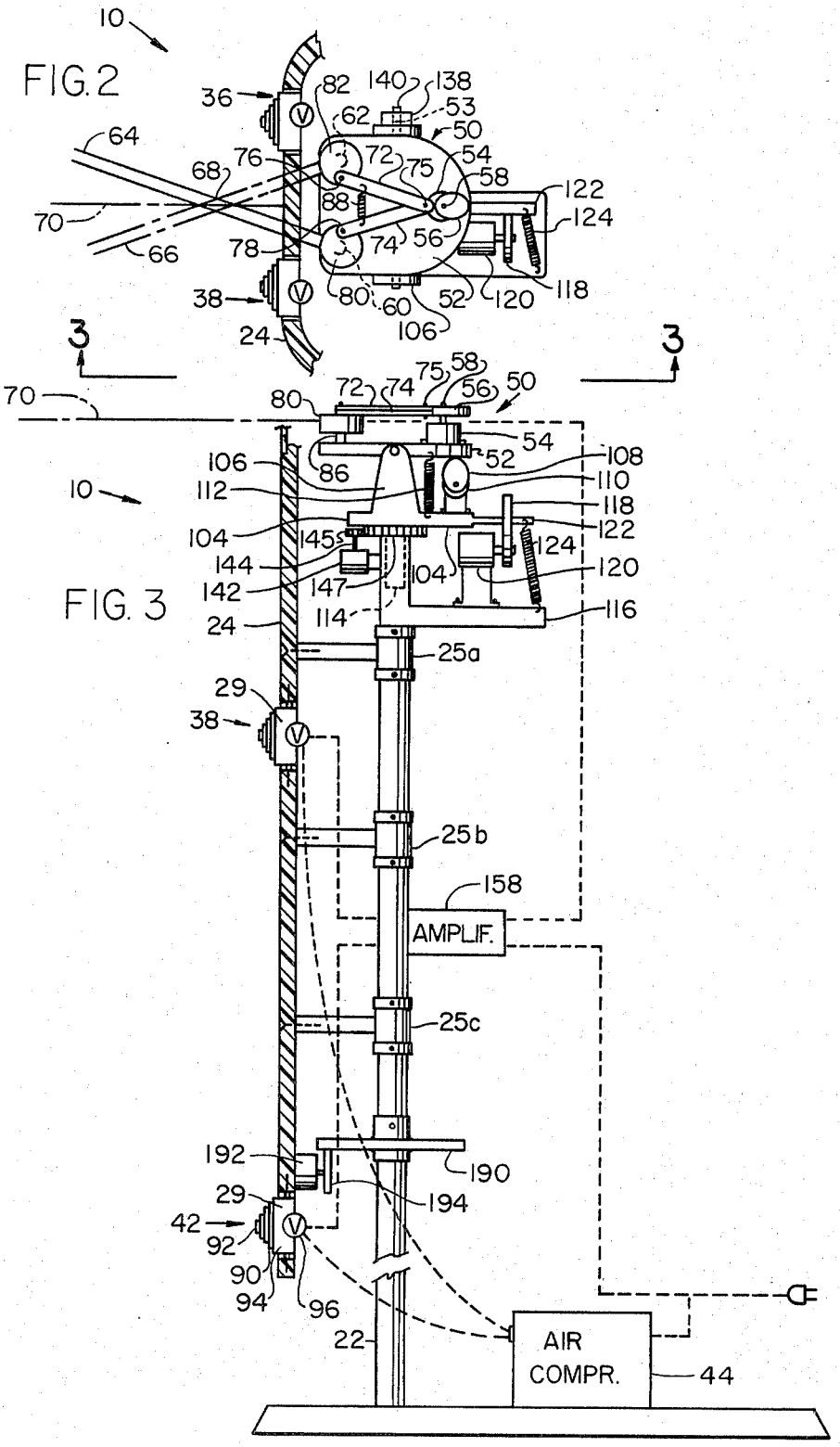
FIG. 2 is a plan view of a mechanism of the invention.
FIG. 3 is a view adapted from 3—3, FIG. 2.

FIGS. 2 and 3 will be described together; they show the invention 10 with all but fragments of the body 24 removed. No claim or restriction is made to any particular range-scanning assembly, that shown at 50 being exemplary of known art. Similarly, no specific gimbal system need be used, that shown for the scanning system being of a vertical series of elements for clarity, but any other type preserving the same relations could be employed for the purpose.

First platform 52 carries a motor 54 with horizontal cam 56 driven by the motor shaft 58. The purpose of the cam 56 is to oscillate the respective pivotally-mounted light beam source 60 and photocell 62 (FIG. 2) in opposite directions so that the light beam 64 and the photocell field of view 66 which intersect at a point 68 are movable in a direction indicated by line of sight 70, the scan in range. For this, as the cam 56 turns, it drives paired links 72, 74 which pivotally join at 75 adjacent the cam and then diverge. The link distal ends have pivotal attachment 76, 78 respectively to light source housing 80 and photocell housing 82, on the inner part of each housing eccentric to the pivotal mountings 84, 86 of the housings. (86 shown in FIG. 3; 84 similar). A tension spring 88 biases the links together to restore the ranging position to the shortest range, as shown. Limits of the scan in range are determined by cam throw and position.

In operation of this first-described portion of the mechanism, the cam 56 may turn continuously, driving the links and producing a scan outward to the farthest desired point, which may be adjusted by moving the motor and cam in the direction of scan. When an object (such as a reflective uniform of a user) reflects light from the beam at the point where the line of sight 66 of the photocell crosses the beam, the photocell will, through means to be described, actuate one or more strikers, as for example 38, to lash out at the user. The body 24, pivots on the base at supports 25*a*, 25*b*, 25*c* (FIG. 3) and, as noted, carries the strikers, each of which has gimbal mounting 29 (as at 42, FIG. 3, for example) to the body.

Each striker 36, 38, 40, 42 may be of the type described in U.S. Pat. No. 4,353,545 issued Oct. 12, 1982 to Tyrone D. Andersen for Athletic Reflex Machine, a pneumatically actuated tapered bellows 90 (at 42, FIG. 3, for example) with the small end 92 closed and the large end hermetically sealed to a cup 94 which in turn passes compressed air actuating the striker as result of action of a solenoid valve 96 controlled by the photocell 62 (FIg. 2). The cup mounts to the gimbal mechanism. As will be described, when the photocell is activated it can send a pulse through a conventional amplifier which can clip the pulse to short duration, and can send the resulting powering pulse through a circuit to a respective solenoid valve 96 at a selected one or more of the strikers, 42 for example, causing the striker to lash out. As will be further described, the solenoid valves are normally open to the atmosphere so that they normally vent the strikers, each of which may have a coil tension spring to return it quickly to the compact position shown.

In addition to the range scan, the unit preferably scans horizontally and vertically, as follows.

Second platform 104 (FIG. 3) below the first platform has pivotal horizontally-opposed journals 106 carrying the first platform for oscillation in a vertical plane transverse to the ranging line 70, and carries the means for oscillating it.

A cam 108 and motor 110 urging it may oscillate the first platform against the bias of return spring 112 between the first and second platform, scanning in elevation (as shown in FIG. 3).

Vertical-axis or horizontal-plane oscillation may be as follows.

The second platform 104 has pivotal attachment 114 about a vertical axis to the pedestal 22.

A third platform 116 integral with the pedestal 22 has a cam 118 and motor 120 similar to the others. The cam horizontally drives an arm 122 integral with a peripheral portion of the second platform, oscillating the second platform against the bias of a tension return-spring 124, scanning horizontally.

In operation, oscillation of the first and second platforms 52, 104 causes the ranging scan represented by line 70 to oscillate vertically and horizontally in search of an opponent. All cams may turn continuously, producing a continuous bobbing and weaving motion of the scan. As will be described, each of the gimbal mountings has an azimuth actuator and an elevation actuator to enable it to follow the scanning system on receiving a signal from the photocell.

The rates of turn of the cams may be the same, or the scan rate may be greater in one or more directions, or made irregular or non-uniform by using conventional stepping motors to turn the cams. Suitable oscillation rate may be arrived at by using conventional variable speed motors and adjusting speed to suit. One to four cycles per second would be a useful training range. As an alternative, the motors and cams may be replaced by conventional pneumatic pistons driven by a master control of a plurality of valves timed by a corresponding plurality of motor-driven adjustable cams similar to that disclosed in the above identified copending application of Tyrone D. Anderson, Ser. No. 239,904, filed Mar. 3, 1981.

These two FIGS., 2 and 3, further indicate control potentiometers for the servo-system to be described. These are conventional, as is the servo-system. In FIG. 2, the potentiometer 138 is an elevation command potentiometer and is fixed to the journal 106 and the rotor 140 is fixed to the axle 53 of platform 52, so relative movement of case and rotor indicate elevational position of platform 52. Similarly in FIG. 3 azimuth command potentiometer 142 is fixed to the pedestal 22 and the rotor 144 is turned through gearing 145 on the rotor and 147 on platform 104, indicating horizontal orientation of the first and second platforms together relative to the pedestal.

The function of motor 192 which had a shaft-mounted rotor 194 driving plate 190 is explained later in detail in reference to FIG. 7, but briefly, it is to orient the body 22 through limited arcs to either side of a central position to face an attacker. The purpose of amplifier and the various lines indicated is explained in reference to later Figures.

Figure 4B:
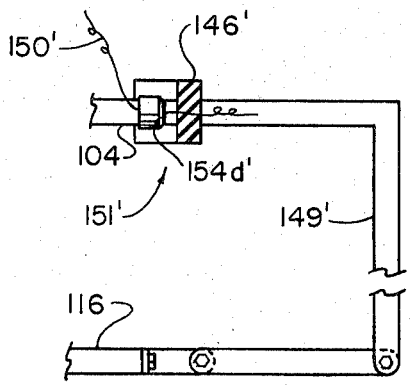
FIG. 4*b* is a schematic diagram, partly in section, of a further selector switch.
Figure 4A:
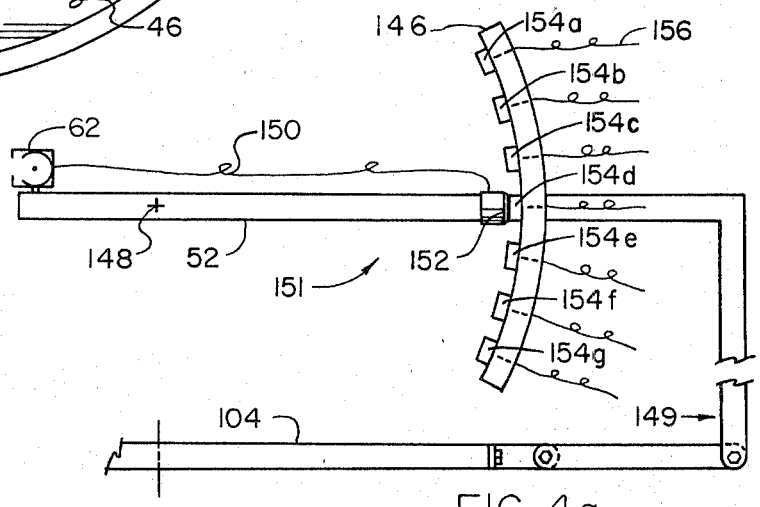
FIG. 4*a* is a fragmentary side view, enlarged, of a selector switch.

FIG. 4*a* indicates that instead of having all strikers lash out at once, means may make the actuation of the strikers selective.

This feature is represented by the following elevational striker-selector switch mechanism which is exemplary only, and to which the provision is not restricted.

A concave spherical strap 146 in the form of a vertical arc may be provided as an area-contact to transmit signals indicative of position causing particular strikers to lash out at correct elevation. The member 146 may be mounted rigidly but adjustably on the rear of the second platform 104 with the curve of the concave face centered on the intersection 148 of the axis of rotation of the first platform 52 with the axis of rotation of the second platform 104. Element 149 is the mounting. Line 150 leads from the photocell 62; mounting of the photocell to the first platform 52 being diagrammatically shown. When the photocell 62 receives a reflection, it signals through lead 150 and through striker circuit selector switch 151 comprising brush 152 and one or more of the contacts 154 *a–g*, spaced apart serially on the surface of member 146, and through one or more of the corresponding lines 156 *a–g*, to a striker or strikers, 156*d* being shown wired to striker 36, enabling the striker or strikers to lash out in the correct direction, and at the same time causing compressed air to be admitted to the striker or strikers, as will be described, so that the invention is a true reflux-machine not just a predictable pre-programmed device. Depending on which of the plurality of separate circuits provided like 156*d* and associated circuitry, is wired to which of the strikers 36, 38, 40, 42, and in which combination, the striker response may be rational or irrational in the sense of striker response proximate to sensed direction, as desired.

FIG. 4*b* diagrams the azimuthal striker-selector switch 151' with curved member 146' which is like the previously described elevational striker-selector switch except that it is horizontally disposed, affixed to the platform 116 by a bracket 149' and the brush 154*d'* (shown) is affixed to the platform 104. Lead 150' is from the photocell, and circuit connections and operations are analogous to those of the elevational striker-selector switch previously described.

Figure 5:
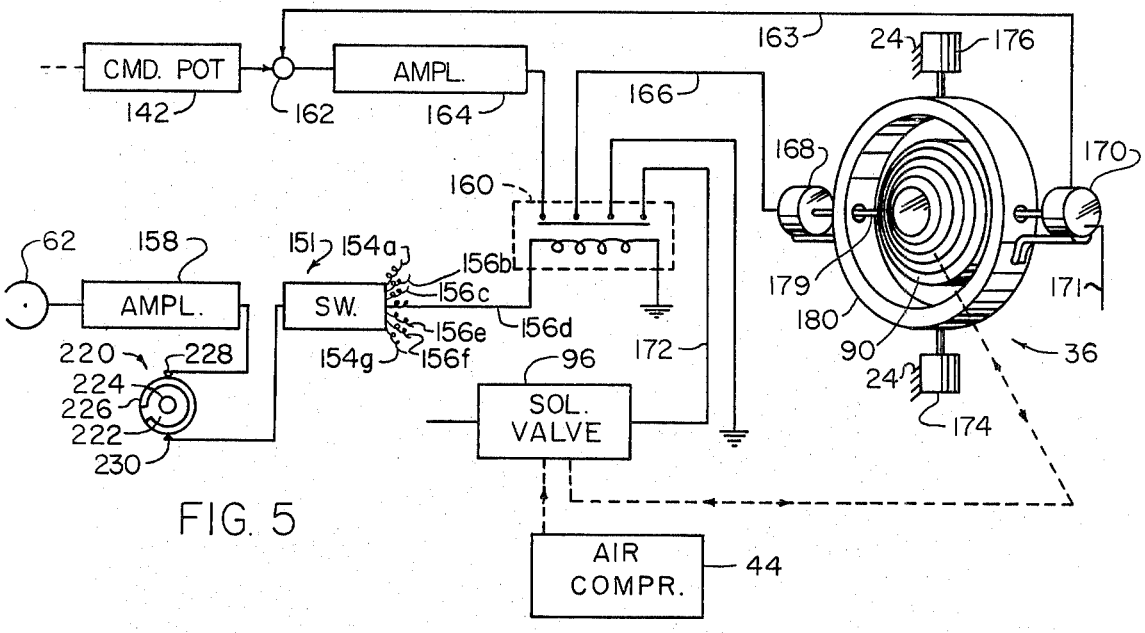
FIG. 5 is a schematic diagram of particular circuitry associated with a striker mechanism.

FIG. 5 diagrams the circuitry for the elevational control by servo-motor of the striker attitudes.

The azimuthal control is by the same type circuit. Photocell 62 receives a signal which is amplified at 158, passes through random contact 220, striker circuit selector switch 151 and closes an associated relay 160. The function of random switch 220 is to interrupt action of the photocell-actuation sporadically and unpredictably. It may be a circular insulative element 222 driven by a motor shaft 224 and having on it an interrupted peripheral conductor 226, rotated at one RPM between contacts 228 and 230 or other random speeds.

Relay 160 performs two functions: (a) it connects azimuth command potentiometer 142 which is signalling azimuth position of the scan, through junction 162 and amplifier 164 and lines 166 with elevation servomotor 168. Potentiometer 170 is driven by servomotor 168 through shaft 179 passing through outer ring 180 of the gimbal, combining the command and feedback potentiometer signals at junction 162, through line 163 amplifying the combined signals at 164, and causing the servomotor 168 to seek a null position, thus reproducing at the gimbal 36 (shown) the elevational position of the photocell scan. Line 171 may conventionally supply a fixed reference voltage to the potentiometer. At the same time, relay 160: (b) activates solenoid valve 96 through lines 172 causing bellows 90 of the gimballed striker to inflate from compressed-air source 44 and lash out to the extended position. Each striker has a similar circuit and, as noted, by connecting two or more circuits as at 174 (broken lines) either temporarily as with a continuously rotating switch or permanently, more than one striker can be made to actuate simultaneously. Each striker has connections to azimuth servomotor 174 driving a feedback potentiometer 176 for the outer gimbal ring 180. The elevational units 168, 170 are mounted on the outer gimbal ring 180 instead of on the body 24 as in the case of the azimuth feedback potentiometer and servomotor.

Said another way, to make it truly reflexive the servo-action causing each gimbal, 36 shown, to assume an elevational angle like that of platform 52 is established only after relay 160 closes.

Relay 160 closes only when a signal is received by the photo-cell 62 and when a contact or contacts 154 *a–g* of the element 151 are in alignment with brush 152, FIG. 4 (which can span more than one contact if desired to be made large enough) so that the response deliberately can be made somewhat unpredictable.

Figure 6:
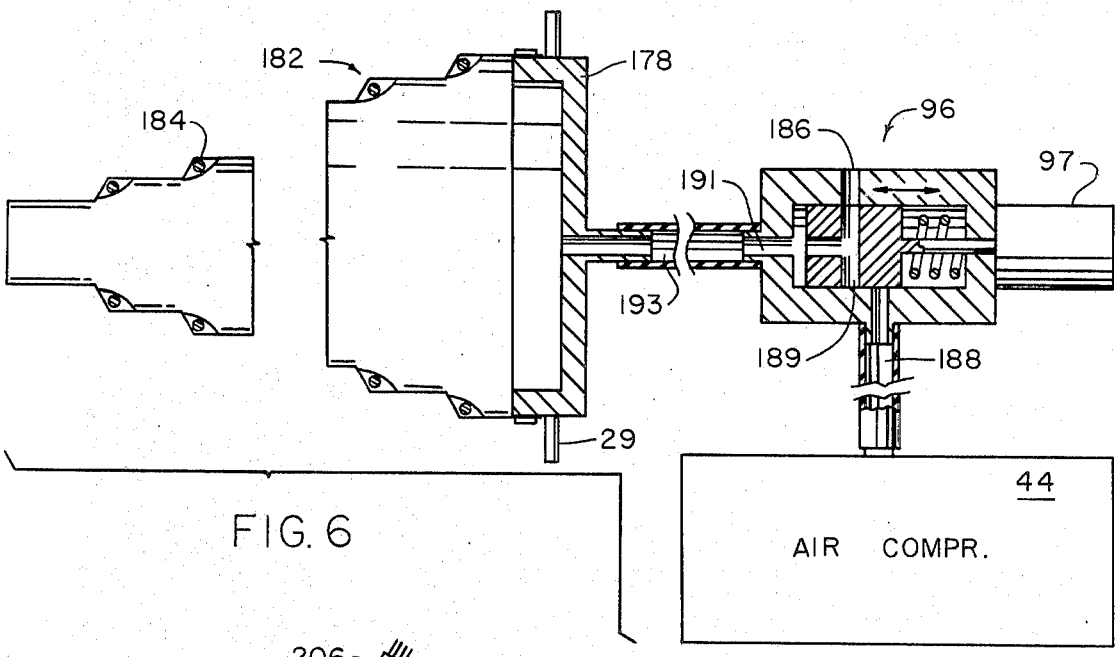
FIG. 6 is a diagram of a bellows striker and connections.

FIG. 6 shows that the bellows 182 of the striker has a closed back or cup mounted on or serving as inner gimbal ring 178, and may have a coiled tension-spring 184 to help pull it to the retracted position. Solenoid valve, 96 shown, driven by solenoid 97, vents the striker through passage 186 to the atmosphere when not activated through passages 188, 189, 191, 193 to the compressed air pump 44.

Figure 7:
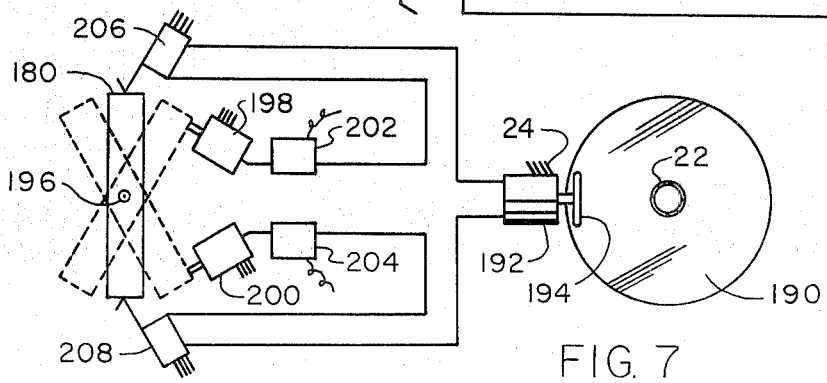
FIG. 7 is a diagram of further circuitry associated with a striker and part of the pedestal support of the invention.

FIG. 7 diagrams in plan view a preferred option of the invention. Plate 190 is fixed to the pedestal 22 (also shown in FIG. 3). Motor 192 has a shaft drive with a gear or a friction rotor 194 engaging the plate 190 which itself may be a gear. Motor 192 is fixed to the body 24. Outer gimbal or azimuthal gimbal 180 of a selected striker (striker omitted for clarity) is indicated in plan view, 196 being the vertical axis. When the gimbal is rotated 45° to either side it strikes a respective corrective switch 198, 200 on the body 24. Each switch connects an opposite-polarity power source, not shown, through a respective relay 202, 204, and similarly at each side through a center-indicating switch 206, 208, with motor 192.

In operation, when the gimbal under photocell control turns 45° to either side of center the motor 192 turns the body 24 to re-center the gimbal. It will be seen that the body can rotate through a maximum arc of 90° to face an opponent but will tend to center and face the opponent.

Finally, a conventional optical filter system can be used to prevent the user from readily seeing which way the scanner beam is directed, the photocell being an infra-red sensitive cell and the source and filter emitting and passing only such wavelengths.

When the body is removed all the mechanism becomes accessible. For this, the body should have quick disconnect bolts and the flexible tubes from the compressor to the solenoid valves should have extra slack in them.

It will be appreciated that ultrasonic or other suitable radiation can be employed for the ranging, and that the scanning need not be precisely horizontal or vertical. Further, concave mirrors, lenses, or any other conventional means may be employed to make the beam from the source parallel and similarly to collimate the acceptance path of the detector.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a system providing for a human opponent a human-reflex simulative device for practicing Kung-Fu and the like, including: a body, means holding the body upright, means on the body for striking out at a human opponent, the improvement comprising: means for controlling said striking out, and said means for controlling including means for remotely sensing a said human opponent.

2. A system as recited in claim 1, said remote sensing including sensing in elevational direction and in azimuthal direction.

3. A system as recited in claim 2, said body having a head portion and said means for remotely sensing being at said head portion.

4. A system as recited in claim 2, each said means for striking out having means for orienting each said means for striking out in accordance with direction of said remote sensing.

5. A system as recited in claim 4, and means for randomly interrupting said striking out.

6. A system as recited in claim 4, and means for causing said system to recenter the orientation of the body toward a said human opponent sensed in sidewise direction.

7. In a system as recited in claim 2, said means for controlling including means for causing more than one of said means for striking out to strike out at the same time.

* * * * *